United States Patent [19]

Makiura

[11] Patent Number: 4,937,622

[45] Date of Patent: Jun. 26, 1990

[54] IMAGE FORMING APPARATUS

[75] Inventor: Yoshinori Makiura, Tondabayashi, Japan

[73] Assignee: Mita Industrial Co., Ltd., Osaka, Japan

[21] Appl. No.: 275,019

[22] Filed: Nov. 22, 1988

[30] Foreign Application Priority Data

Nov. 30, 1987 [JP] Japan ..... 62-301866

[51] Int. Cl.[5] ..... G03G 15/00

[52] U.S. Cl. ..... 355/206; 355/316; 271/259

[58] Field of Search ..... 355/204, 206, 208, 209, 355/309, 311, 316, 205; 271/258, 259; 340/673-675

[56] References Cited

U.S. PATENT DOCUMENTS 4,307,957 12/1981 Kitagawa et al. ..... 355/206

*Primary Examiner*—Joan H. Pendegrass

*Attorney, Agent, or Firm*—Beveridge, DeGrandi & Weilacher

[57] ABSTRACT

An image forming apparatus having a plurality of copy paper detector sensors in a delivery passage for copy paper. After a first copy paper detector sensor has been turned ON, if a copy paper detector sensor just downstream of the first copy paper detector sensor is not turned ON within a predetermined period of time, there are checked the ON/OFF status of the first copy paper detector sensor and copy paper detector sensors upstream thereof. If one or more of the copy paper detector sensors are ON, the length of the copy paper is compared with a distance between each of the last-mentioned copy paper detector sensors and a copy paper detector sensor just downstream thereof. Based on the comparison result, the position where the copy paper has jammed, is judged.

2 Claims, 4 Drawing Sheets

IMAGE FORMING APPARATUS

BACKGROUND OF THE INVENTION

The present invention relates to an image forming apparatus, such as an electrophotographic copying apparatus or an electrophotographic-type printer, which is capable of detecting a jam of copy paper on which an image is to be transferred.

A copy paper jam detection device in an image forming apparatus such as an electrophotographic copying apparatus generally includes one or more detection switches disposed in the copy paper delivery passage and a timer mechanism. Such a device employs a method in which a paper jam is judged to have happened if the time during which each detection switch is ON, or the time during which each detection switch is changed in status from ON to OFF or from OFF to ON, is longer than a period of time preset in the timer mechanism (See, for example, the Japanese Utility Model Publication Examined No. 7956/1980).

In view of the nature of such a detection device, time setting has been made based on the copy paper of a maximum length allowed to be used in the image forming apparatus. Accordingly, while the copy paper of the maximum length is being used, a paper jam, if happened, may be smoothly detected. However, this method has disadvantageously detected, with delay or error, a paper jam happened while, for example, the copy paper of a minimum size is being used.

To overcome the defect above-mentioned, there has been proposed a jam detection method in which a period of time to be set in the timer mechanism may be changed, as necessary, according to the length of copy paper to be used, as disclosed by the Japanese Laid-Open Patent Publication No. 139765/1982 or No. 131650/1982.

According to the method proposed by the Publications above-mentioned, a period of time to be set in a timer may be changed according to the length of paper to be used. Thus, a paper jam may be detected securely and rapidly. However, likewise a conventional prior art, this method includes room for further improvements in that the place where a paper jam has happened cannot be detected accurately dependent on the sizes of copy paper to be used.

More specifically, where a jam has been detected because one detection switch was not turned ON or OFF as it would be normally done, within a period of time preset in the timer, it is difficult to judge whether a major portion of the jammed paper is present upstream or downstream of the detection switch above-mentioned.

It is an object of the present invention is to provide an image forming apparatus having a function capable of judging the exact place where a paper jam has happened even if the size of copy paper changes, so as to inform the exact jam place to the operator.

SUMMARY OF THE INVENTION

The image forming apparatus in accordance with the present invention includes, in a copy paper delivery passage, first copy paper detector means and second copy paper detector means downstream thereof as separated by a distance l therefrom.

Timer means is disposed for counting a period of time between the ON-operation of the first copy paper detector means by copy paper to be delivered and the ON-operation of the second copy paper detector means. The timer means is adapted to supply a signal if an ON-signal of the second copy paper detector means is not supplied within a preset time T1.

Further disposed is size data output means for supplying copy paper size data including the length L of the copy paper to be delivered.

When the timer means supplies a signal, the status of the first copy paper detector means is judged. At this time, if the first copy paper detector means is OFF, it is then judged that a copy paper jam has happened between the first copy paper detector means and the second copy paper detector means.

On the contrary, if the first copy paper detector means is ON, the distance mentioned earlier is then compared with the data of copy paper length L supplied from the size data output means. At this time, if the distance l is equal to or greater than the paper length L, i.e., if the copy paper length L is relatively short, it is then judged that the paper jam has happened upstream of the first copy paper detector means in the delivery passage. On the contrary, if the distance l is smaller than the paper length L, i.e., if the paper length L is relatively long, it is then judged that the paper jam has happened between the first copy paper detector means and the second copy paper detector means.

Thus, based on the ON/OFF status of the copy paper detector means and the result of comparison of the copy paper length L with the section distance l in the copy paper delivery passage, there may be judged a jam occurrence place which would be thought to be with the highest probability.

The above-mentioned and other objects of the present invention will be described with reference to the attached drawings.

DETAILED DESCRIPTION OF THE PREFERRED EMBODIMENTS

Figure 1:
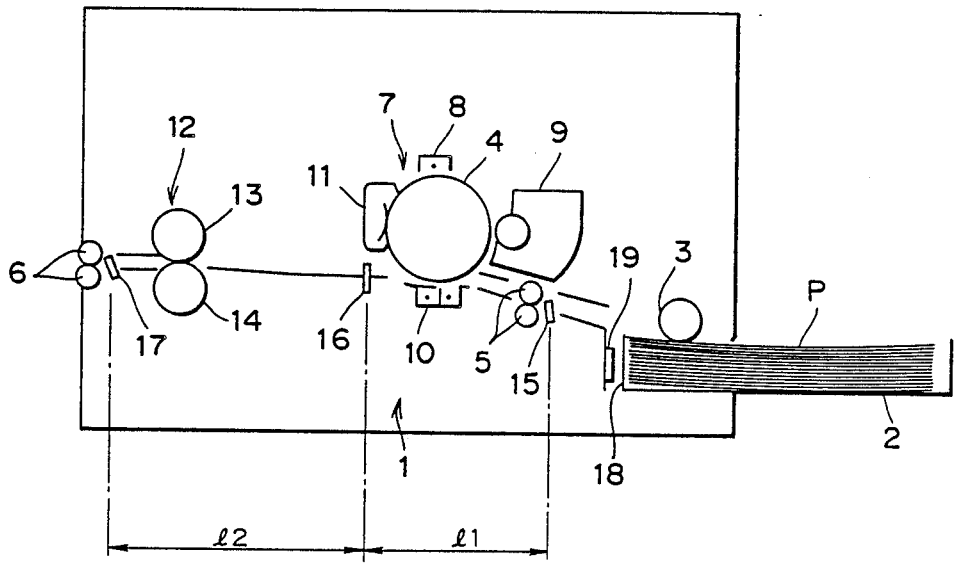
FIG. 1 a schematic view of a copy paper delivery passage of an electrophotographic copying apparatus in accordance with an embodiment of the present invention.

FIG. 1 is a schematic view of a copy paper delivery passage 1 of an electrophotographic copying apparatus in accordance with an embodiment of the present invention.

The delivery passage 1 includes a copy paper feeding roller 3 for taking out copy paper P set in a cassette 2, a pair of resist rollers 5 for delivering the copy paper P thus taken out, in predetermined timing to a photoreceptor drum 4, and a pair of copy paper discharging rollers 6 disposed at the terminal end of the delivery passage 1. An image forming processing section 7 including the photoreceptor drum 4 is disposed downstream of the resist rollers 5. The image forming processing section 7 further includes, around the photoreceptor drum 4, a corona discharger 8, a developing device 9, a transferring/separating charger 10 and a cleaner 11 successively arranged in the rotation direction of the photoreceptor drum 4.

In the image forming processing section 7, the copy paper P delivered by the delivery passage 1 is adapted to closely stick to the surface of the photoreceptor drum 4, by the rotation of which the copy paper P passes on the transferring/separating charger 10 such that a toner image formed on the surface of the photoreceptor drum 4 is transferred onto the copy paper P. The copy paper P having the toner image thereon is then delivered in the downstream direction of the delivery passage 1.

A fixing device 12 is disposed downstream of the image forming processing section 7. The fixing device 12 includes a fixing roller 13 and a delivery roller 14. When the copy paper P passes between these two rollers 13, 14, the toner image transferred onto the copy paper P is adapted to be fixed thereon. The copy paper P having the toner image fixed thereon, is adapted to be discharged outside of the copying apparatus by the pair of discharge rollers 6.

Disposed in the delivery passage 1 are three copy paper detection sensors, i.e., a first sensor 15 disposed immediately upstream of the pair of the resist rollers 5, a second sensor 16 disposed immediately downstream of the image forming processing section 7 and between the image forming processing section 7 and the fixing device 12, and a third sensor 17 immediately upstream of the pair of discharge rollers 6. All sensors 15 to 17 made by, for example, microswitches or photosensors, are adapted to be turned ON when the tip end of the copy paper P starts passing thereby, and to be turned OFF when the the passage of the copy paper P at the terminal end thereof is completed.

The first sensor 15 is separated from the second sensor 16 by a distance l 1 along the delivery passage 1, and the second sensor 16 is separated from the third sensor 17 by a distance l 2 along the delivery passage 1.

The cassette 2 is provided at the front external surface 18 with a display unit (not shown) on which the size data of the copy paper P are to be displayed. The size data include the length L of the copy paper P. The apparatus is further provided with a reading sensor 19 at the position thereof opposite to the size data display unit of the cassette 2 at its front external surface 18 when the cassette 2 is mounted on the copying apparatus. The reading sensor 19 is adapted to read the size data.

Figure 2:
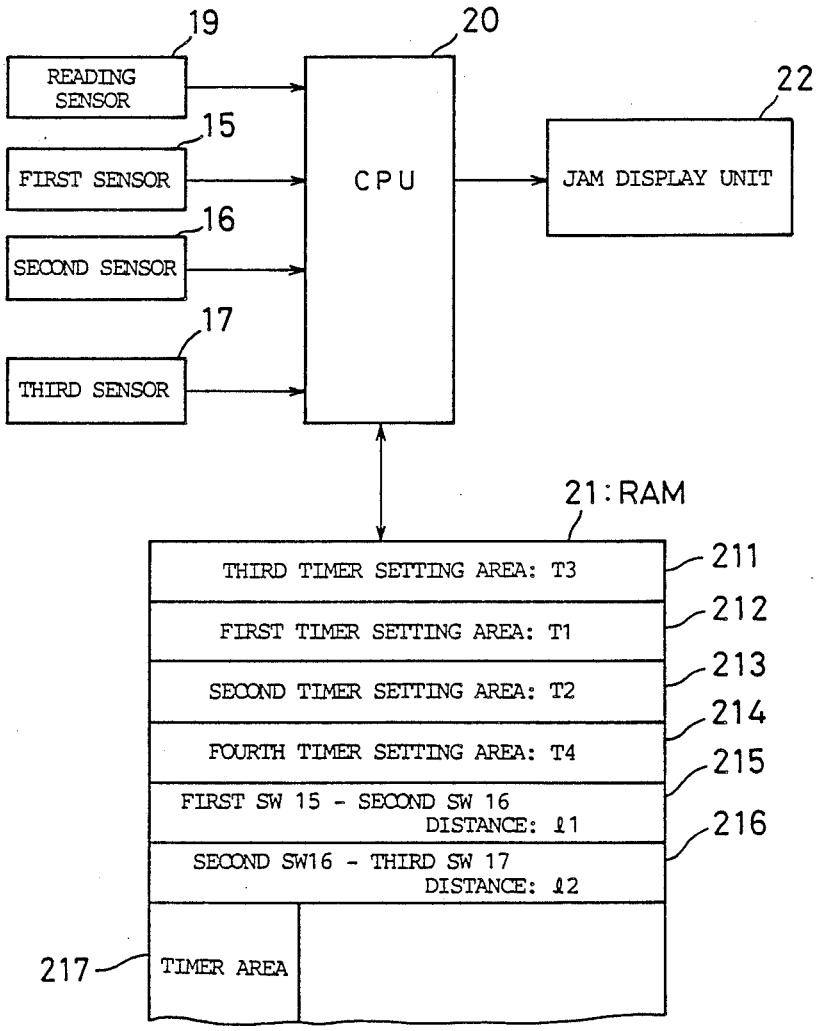
FIG. 2 is a block diagram of controlling a jam detection processing executed in the electrophotographic copying apparatus of the embodiment of the present invention.

FIG. 2 is a block diagram illustrating the arrangement of a control unit for a jam detection processing in the electrophotographic copying apparatus having the arrangement above-mentioned.

As shown in FIG. 2, the control unit includes a CPU 20 adapted to receive data supplied from the reading sensor 19, the first sensor 15, the second sensor 16 and the third sensor 17 discussed in connection with FIG. 1. The CPU 20 is connected to a RAM 21 serving as a memory which includes:

(i) four timer time setting areas, i.e., an area 211 for setting a third timer time T3, an area 212 for setting a first timer time T1, an area 213 for setting a second timer time T2 and an area 214 for setting a fourth timer time T4; and (ii) two distance setting areas, i.e., an area 215 for setting the distance l 1 between the first switch 15 and the second switch 16, an area 216 for setting the distance l 2 between the second switch 16 and the third switch 17.

The data above-mentioned are respectively preset in these areas.

The CPU 20 is adapted to execute four soft-timer functions with the use of a timer area 217 of the RAM 21. More specifically, the CPU 20 is provided with:

- a third timer for counting a period of time t3 between the operation start of the paper feeding roller 3 and the ON-operation of the first sensor 15;
- a first timer for counting a period of time t1 between the operation start of the resist rollers 5 and the ON-operation of the second sensor 16;
- a second timer for counting a period of time t2 between the ON-operation of the second sensor 16 and the ON-operation of the third sensor 17; and
- a fourth timer for counting a period of time t4 between the ON-operation of the third sensor 17 and the OFF-operation of the third sensor 17.

The third timer is adapted to be exhausted when the time t3 counted by the third timer has reached the time T3 preset in the setting area 211. Likewise, the first timer, the second timer and the fourth timer are adapted to be respectively exhausted when the time t1 counted by the first timer has reached T1, when the time t2 counted by the second timer has reached T2, and when the time t4 counted by the fourth timer has reached T4.

Thus, the CPU 20 may detect the occurrence of a copy paper jam by respectively comparing signals supplied by the sensors and operation signals supplied from the copying apparatus with the preset values in the RAM 21. The place where the jam has happened is displayed on a jam display unit 22 as discussed in the following.

Figure 3:
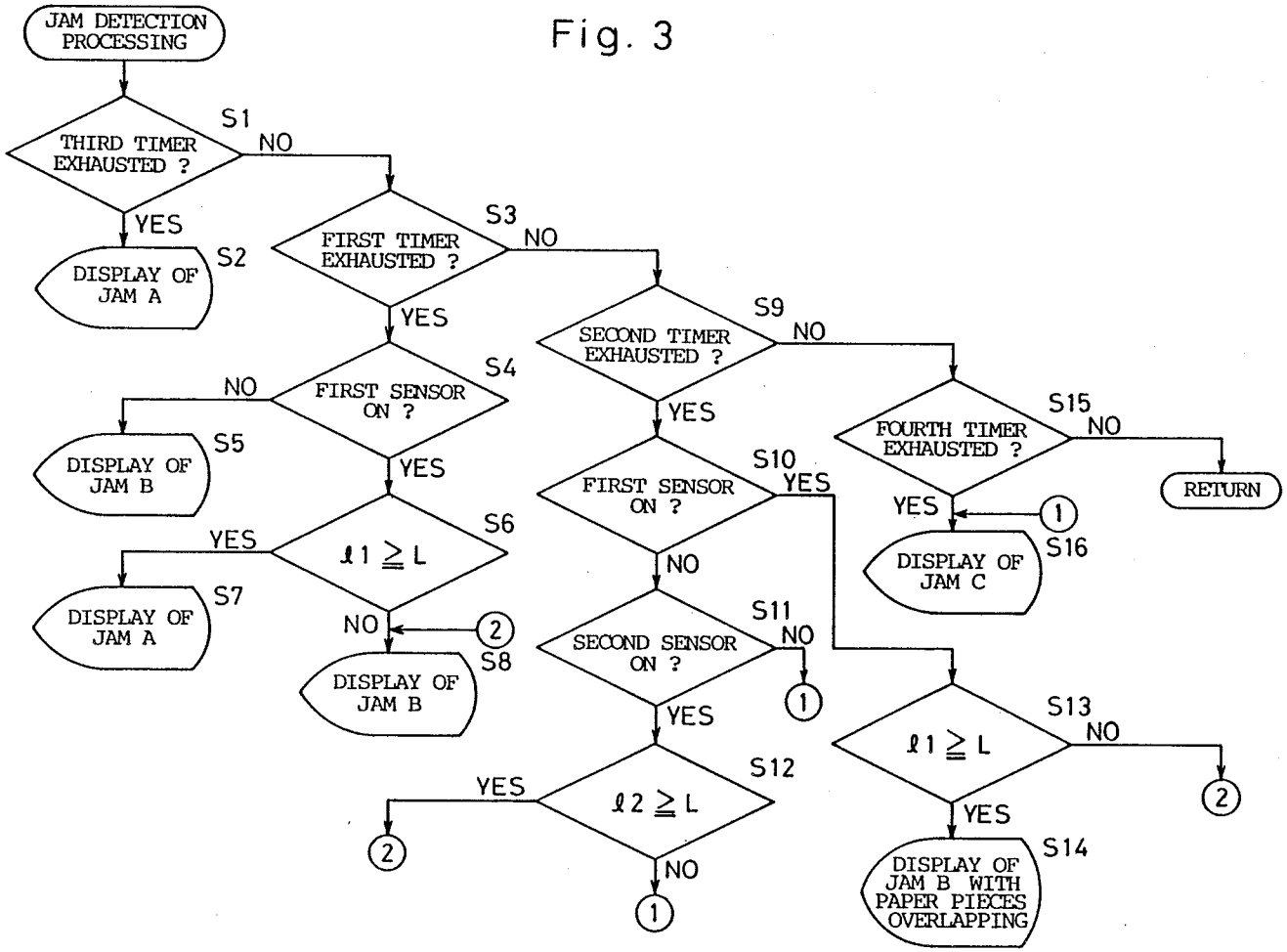
FIG. 3 is a flowchart illustrating steps of the jam detection processing.

FIG. 3 is a flowchart illustrating a control operation for the jam detection processing of the CPU 20 in FIG. 2. The processing in FIG. 3 may be executed as interrupting the processing executed by the main program, at predetermined time intervals.

The following description will discuss the jam detection processing of the CPU 20 with reference to FIG. 1 to FIG. 3.

When the jam detection processing starts, the CPU 20 judges whether or not the third timer has exhausted (Step S1). That is, the third timer counts the time t3 between the operation start of the paper feeding roller 3 and the ON-operation of the first sensor 15. The third timer is exhausted if the first sensor 15 is not turned ON within the preset time T3. If the third timer is exhausted, the CPU 20 indicates a Jam A on the jam display unit 22 (Step S2).

The Jam A is a display representing that a copy paper jam has happened between the paper feeding roller 3 and the resist rollers 5 in the delivery passage (paper feeding passage).

If the third timer is not exhuasted, it is then judged whether or not the first timer is exhausted (Step S3). As mentioned earlier, the first timer counts the time t1 between the operation start of the resist rollers 5 and the ON-operation of the second sensor 16. If no signal is supplied from the second sensor 16 while the time t1 reaches the preset time T1, this means that copy paper has not been sent to the second sensor 16 as would be normally done. Accordingly, the first timer is exhausted.

If it is judged that the first timer has been exhausted, the CPU 20 then judges the status of the first sensor 15 (Step S4). If the first sensor 15 is OFF, this means that the copy paper P has been delivered to the image forming processing section 7 by the resist rollers 5. A Jam B is then displayed (Step S5).

The Jam B is a display representing that a copy paper jam has happened in the image forming processing section 7. In this case, the copy paper P has been often wound on the photoreceptor drum 4.

On the contrary, if the CPU 20 judges that the first sensor 15 is ON, the distance l 1 between the first sensor 15 and the second sensor 16 is then compared in size with the length L of the copy paper P (Step S6). If the distance l 1 is equal to or greater than the length L of the copy paper, the Jam A is then displayed (Step S7). If the distance l 1 is smaller than the length L of the copy paper, the Jam B is then displayed (Step S8).

More specifically, when the copy paper P used has small sizes with the length L smaller than the distance l 1, there is more probability that a major portion of the copy paper P remains between the paper feeding roller 3 and the resist rollers 5 in the paper feeding passage. It is therefore more reasonable and practicable to judge that the paper jam has happened in the paper feeding passage. On the contrary, when the copy paper P used has large sizes with the length L greater than the distance l 1, there is more probability that a major portion of the copy paper P has passed through the resist rollers 5 and remains in the image forming processing section 7, and that the image forming processing section 7 is indicated as a jam occurrence place. Thus, the jam occurrence display place may vary dependent on the length L of the copy paper P.

If the first timer has not been exhausted, the CPU further judges whether or not the second timer has been exhausted (Step S9). If it is judged that the second timer has been exhausted, the status of the first sensor 15 is judged (Step S10). If the first sensor 15 is ON, this means that the copy paper P is present at least between the first sensor 15 and the second sensor 16 and that the tip end of the copy paper P does not reach the third sensor 17. Accordingly, the length L of the copy paper P is then compared in size with the distance l 1 between the first sensor 15 and the second sensor 16 (Step S13). If the distance l 1 is equal to or greater than the length L of the copy paper, it is then judged that not only one copy paper piece P but also a plurality of copy paper pieces P are being jammed in an overlap manner. Then, there is displayed the occurrence of a jam which is the Jam B in the image forming processing section 7 and which is accompanied by an overlap of copy paper pieces (Step S14). On the contrary, if the length L of the copy paper is greater than the distance l 1, it may be judged that a major portion of the copy paper P remains in the image forming processing section 7. It is therefore displayed that the Jam B representing a jam in the image forming processing section 7 has happened (Step S8).

If the second timer has been exhausted and the first sensor 15 is OFF, the status of the second sensor 16 is then judged (Step S11). If the second sensor 16 is OFF, this means that the copy paper has been given to the fixing device 12. Accordingly, a Jam C is displayed (Step S16).

The Jam C is a display representing that a copy paper jam has happened in the fixing processing section 12.

On the contrary, if the second sensor 16 is ON, the copy paper length L is compared in size with the distance l 2 between the second sensor 16 and the third sensor 17 (Step S12). If the copy paper length L is smaller than the distance l 2, the Jam B is then displayed (Step S8), and if the copy paper length L is equal to or greater than the distance l 2, the Jam C is then displayed (Step S16). This is based on the following actual facts:

That is, if the second sensor 16 is ON where the copy paper length L is smaller than the distance l 2, there is more probability that a major portion of the copy paper P still remains in the image forming processing section 7 and that the jam has actually happened in the image forming processing section 7. On the other hand, if the copy paper length L is equal to or greater than the distance l 2, there is more probability that a major portion of the copy paper P has been delivered to the fixing device 12 in which a jam has happened.

It is therefore possible to display accurately a jam occurrence place in conformity with the actual facts, based on the judgement of the length L of the copy paper P.

If the second timer has not been exhausted, it is then judged whether or not the fourth timer 17 has been exhausted (Step S15). If the fourth timer 17 has been exhausted, the Jam C is displayed (Step S16).

The judgement processing of the CPU 20 in the foregoing is collectively shown in Table 1.

TABLE 1

| Exhausted Timer | Sensor Status: First Sensor | Second Sensor | Third Sensor | Indication on Display Unit |
|---|---|---|---|---|
| Third Timer | OFF | — | — | A |
| First Timer | OFF | OFF | — | B |
| | l1 ≧ L | | | A |
| | ON | OFF | — | |
| | l1 < L | | | B |
| Second Timer | OFF | OFF | OFF | C |
| | | l2 ≧ L | | B |
| | | ON | OFF | |
| | | l2 < L | | C |
| | l1 ≧ L | | | B overlap |
| | ON | — | OFF | |
| | l1 < L | | | B |
| Fourth Timer | — | — | ON | C |

As thus discussed, the display of a jam occurrence place may be changed by comparing the length L of copy paper used with the preset distances l 1 and l 2. Accordingly, if a jam has happened, the actual jam place may be displayed more accurately.

Accordingly, based on the display of jam occurrence and its occurrence place, the user of the image forming apparatus of the present invention may confirm the accurate jam occurrence place, thereby to promptly execute a jam releasing processing.

The present invention should not be limited to the embodiment hereinbefore illustrated and described.

For example, in the embodiment in FIG. 1, the delivery passage 1 includes the first sensor 15 immediately upstream of the resist rollers 5, the second sensor 16 immediately downstream of the image forming processing section 7 and between the fixing device 12 and the image forming processing section 7, and the third sensor 17 immediately upstream of the discharge rollers 6. However, the number of the sensors may be increased to enhance the precision of judging the jam occurrence place.

Alternately, the number of the sensors may be decreased. The present invention may be embodied with at least two sensors. For example, the third sensor 17 in FIG. 1 may be eliminated. In FIG. 2, the third sensor 17 and the fourth timer time T4 setting area 214 may be eliminated. The second timer may be so arrnged as to count the time t2 between the ON-operation of the second sensor 16 and the OFF-operation of the second sensor 16. In this case, the control steps in FIG. 4 may be adopted, instead of the control steps in FIG. 3.

Figure 4:
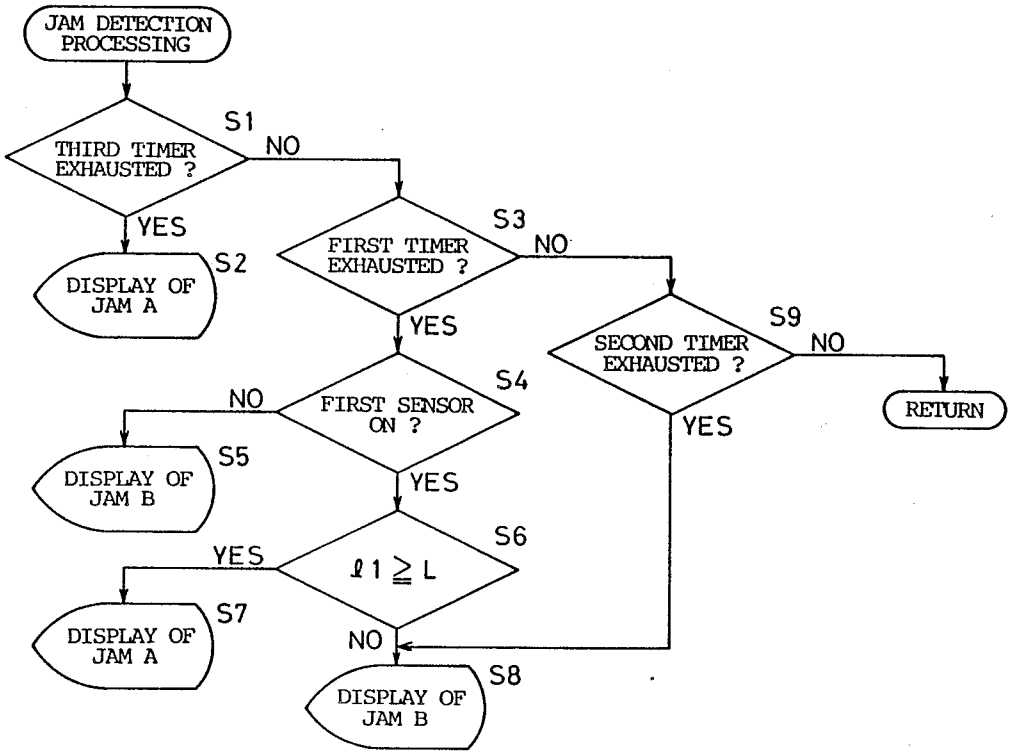
FIG. 4 is a flowchart illustrating steps of the jam detection processing with the use of two copy paper detection sensors.

At the step S9 in FIG. 4, if the copy paper P passes before the second timer is exhausted, the CPU 20 is immediately returned. When the second timer is exhausted, the Jam B is then displayed. Other steps in FIG. 4 are the same as those in FIG. 3. According to the control steps in FIG. 4, it may be judged whether the copy paper jam has happened in the image forming processing section 7 (Jam B) or between the paper feeding roller 3 and the resist rollers 5 in the delivery passage (paper feeding pasage) (Jam A).

Other variations and modification of the present invention may be made without departing from the scope of the invention.

What I claim is:

1. An image forming apparatus comprising:

a delivery passage for copy paper on which an image is to be reproduced;

first copy paper detector means disposed along said delivery passage;

second copy paper detector means disposed downstream of said first copy paper detector means in said delivery passage and separated by a distance l from said first copy paper detector means;

timer means for counting a period of time between the ON-operation of said first copy paper detector means by copy paper to be delivered and the ON-operation of said second copy paper detector means, said timer means being adapted to supply a signal if said second copy paper detector means does not supply an ON-signal within a preset time T;

size data output means for supplying copy paper size data including the length L of the copy paper to be delivered;

jam occurrence place judging means for:

examining the status of said first copy paper detector means if said timer means supplies a signal, so as to judge that a copy paper jam has happened between said first copy paper detector means and said second copy paper detector means if said first copy paper detector means is OFF; and further comparing said distance l with the data of copy paper length L supplied from said size data output means if said first copy paper detector means is ON, so as to judge that a copy paper jam has happened upstream of said first copy paper detector means in said delivery passage if said distance l is equal to or greater than said length L, and judge that a copy paper jam has happened between said first copy paper detector means and said second copy paper detector means if said distance l is smaller than said length L; and, means for displaying the results of the jam occurrence place judging.

2. An image forming apparatus comprising:

a delivery passage for copy paper on which an image is to be reproduced;

an image forming processing section and a fixing processing section disposed, in this order, along said delivery passage;

a first sensor disposed upstream of said image forming processing section in said delivery passage for detecting the passage of the copy paper;

a second sensor disposed between said image forming processing section and said fixing processing section in said delivery passage and separated by a distance l 1 from said first sensor;

a third sensor disposed downstream of said fixing processing section in said delivery passage and separated by a distance l 2 from said second sensor;

a first timer for counting a period of time between the ON-operation of said first sensor by copy paper to be delivered to said image forming processing section in predetermined timing and the ON-operation of said second sensor, said first timer being adapted to supply a signal if said second sensor does not supply a signal within a preset time T1;

a second timer for counting a period of time between the ON-operation of said second sensor and the ON-operation of said third sensor, said second timer being adapted to supply a signal if said third sensor does not supply an ON-signal within a preset time T2;

size data output means for supplying copy paper size data including the length L of the copy paper to be delivered;

first jam occurrence place judging means for:

examining the status of said first sensor if said first timer means supplies a signal, so as to judge that a copy paper jam has happened in said image forming processing section if said first sensor is OFF; and further comparing said distance l 1 with the data of copy paper length L supplied from said size data output means if said first sensor is ON, so as to judge that a copy paper jam has happened upstream of said image forming processing section in said delivery passage if said distance l 1 is equal to or greater than said length L, and judge that a copy paper jam has happened in said image forming processing section if said distance l 1 is smaller than said length L;

second jam occurrence place judging means for;

examining the status of said first and second sensors if said second timer supplies a signal, so as to judge that a copy paper jam has happened in said fixing processing section if both said first and second sensors are OFF;

further comparing said distance l.2 with said copy paper length L if said first sensor is OFF and said second sensor is ON, so as to judge that a copy paper jam has happened in said image forming processing section if said distance l 2 is equal to or greater than said length L; and judge that a copy paper jam has happened in said fixing processing section if said distance l 2 is smaller than said length L;

further comparing said copy paper length L with said distance l 1 if said first sensor is ON, so as to judge that a copy paper overlap jam has happened upstream of said image forming processing section if said distance l 1 is equal to or greater than said length L, and judge that a copy paper jam has happened in said image forming processing section if said distance l 1 is smaller than said length L; and, means for displaying the results of the jam occurrence place judging.

* * * * *

UNITED STATES PATENT AND TRADEMARK OFFICE

CERTIFICATE OF CORRECTION

PATENT NO. : 4,937,622

DATED : June 26, 1990

INVENTOR(S) : MAKIURA

It is certified that error appears in the above-identified patent and that said Letters Patent is hereby corrected as shown below:

Column 8, line 17 (Claim 1) replace

"supply a signal" with --supply an ON-signal--.

Signed and Sealed this

Seventeenth Day of December, 1991

*Attest:*

HARRY F. MANBECK, JR.

*Attesting Officer*

*Commissioner of Patents and Trademarks*